US005095794A

United States Patent [19]

Mendenhall

[11] Patent Number: 5,095,794

[45] Date of Patent: Mar. 17, 1992

[54] CUTTER BLADE ASSEMBLY FOR HYDRAULIC FOOD CUTTING APPARATUS

[76] Inventor: George A. Mendenhall, 4252 S. Eagleson Rd., Boise, Id. 83705

[21] Appl. No.: 709,194

[22] Filed: Jun. 3, 1991

Related U.S. Application Data

[60] Continuation of Ser. No. 344,241, Apr. 25, 1989, abandoned, which is a division of Ser. No. 181,099, Apr. 13, 1988, Pat. No. 5,058,478.

[51] Int. Cl.[5] ..... B26D 1/03; B26D 3/18

[52] U.S. Cl. ..... 83/858; 83/402; 83/404.3

[58] Field of Search ..... 83/98, 402, 404.3, 856–858

[56] References Cited

U.S. PATENT DOCUMENTS

| | | | |
|---|---|---|---|
| 3,109,468 | 11/1963 | Lamb et al. | 83/98 |
| 3,116,772 | 2/1963 | Lamb et al. . | |
| 4,082,024 | 4/1978 | Hodges et al. | 83/402 |
| 4,300,429 | 11/1981 | Brown et al. | 83/857 |
| 4,372,184 | 2/1983 | Fisher et al. | 83/404.3 |
| 4,423,652 | 1/1984 | Winslow | 83/402 |
| 4,766,793 | 8/1988 | Fischer et al. | 83/857 |
| 4,807,503 | 2/1989 | Mendenhall | 83/858 |

FOREIGN PATENT DOCUMENTS

| | | |
|---|---|---|
| 8601282 | 12/1987 | Netherlands . |
| 643708 | 9/1950 | United Kingdom . |

*Primary Examiner*—Hien H. Phan

*Attorney, Agent, or Firm*—Frank J. Dykas; Craig M. Korfanta; Ken J. Pedersen

[57] ABSTRACT

A cutter blade assembly 100 for producing elongated string cuts of food product using a hydraulic cutting apparatus where the elongated string cuts produced are free from feather cuts and compression cell damage, and further have small cross-sectional areas. The cutter blade assembly 100 is constructed from a front inlet adapter plate 101 having an inner longitudinal passageway therethrough shaped to form a conical converger 102. Pyramidal knife supports 103, 104, 105 and 106, are attached in opposing pairs around conical converger 102 to the back of front inlet adapter plate 101 to form a pyramidal frame. A plurality of strip knives are attached in a staggered perpendicular interlocking arrangement to form a sequential cutting grid.

3 Claims, 13 Drawing Sheets

CUTTER BLADE ASSEMBLY FOR HYDRAULIC FOOD CUTTING APPARATUS

This application is a continuation of application Ser. No. 07/344,241, filed 04/25/89, now abandoned, which is a divisional application of Ser. No. 07/181,099, filed 04/13/88, now U.S. Pat. No. 5,058,478.

BACKGROUND OF THE INVENTION

1. Technical Field

This invention relates to the cutting of food product with hydraulic food cutting apparatus. In particular it relates to an improved blade assembly for cutting elongated segments of food product of small cross-sectional areas.

2. Background Art

There are three basic methods of preserving processed food, the first is canning, the second is freezing, and the third is dehydrating. Until now, processed potatoes such as french fries and hash browns have been preserved only by freezing. In order to produce dehydrated potato product such as an instant mashed potatoes base, the processor must mechanically cut the potato into finely chopped pieces or flakes, or in the alternative, must completely break down the cellular structure of the potato in order to form an extruded, processed, mash which can then be dried and chipped. All of this has, until today, been done by means of mechanical cutting apparati which are, by their very design, cumbersome, of low tonnage capacity, and expensive.

As an alternative to mechanical cutters for vegetable products, a class of devices known as hydroknives have been developed. Hydroknives suspend the food product in a carrier medium, usually water, and pump it through an alignment and acceleration tube which is similar in shape and function to the front half of a venturi into a longitudinal passageway holding a cutter blade assembly. The food product, traveling at speeds approximately 60 feet per second, impinges against the cutter blade assembly and is thereby sheared into a plurality of segments. Such hydroknife cutting apparati have the distinct advantage of higher capacity when compared to mechanical cutters, but until now, have been limited as to the smallness of the segmental size which can be cut. As a practical matter, the smallest size that is normally cut with a conventional hydroknife is approximately 0.08 square inches in cross-sectional area, which is the size of a standard french fry. Smaller cuts such as those for European style french fries, shoestring french fries, hash browns and the like, are made mechanically.

F. G. LAMB, ET AL., U.S. Pat. No. 3,109,468, discloses a typical hydraulic cutting apparatus wherein the food product to be cut, namely potatoes, are dropped into a tank filled with water and then pumped through conduit into an alignment chute wherein the potatoes are aligned and accelerated to a high speed before impinging upon a cutter blade assembly where the potato core is cut into a plurality of french fries and the peripheral area of potato is sliced off and diverted from the main flow of core product for later retrieval for other uses. LAMB further teaches a cutter blade assembly for producing potato segments having a large square cross-sectional area. The outermost blades extend the full length of the cutting assembly while the inner blades decrease in length as they are disposed closer and closer to the longitudinal axis of the cutting apparatus.

The problem with the cutter blade assembly as taught by LAMB, is that it produces potato segments which have a relatively large cross-sectional area and a high percentage of segments that are defective. A certain percentage of the potato segments will have feather cuts on their cornered edges and some will have substantial cell damage as a result of the compression experienced within the cutter blade assembly. Also, in practice it has been found that attempts to reduce segment size by simply adding more cutting knives to the apparatus as taught by LAMB, and thereby reducing the cross-sectional area of the cut product, results in frequent clogging of the cutter apparatus.

To date, the current state of the art has no solution for the clogging problem experienced when attempting to cut segments of small cross-sectional area, and only a partial and inadequate solution to the feathered cut problem. The percentage of segments having feathered cuts can be reduced, but not eliminated, by preheating the uncut food product to between 90° F. to 120° F. While this does not eliminate feathered cuts, it is the best that the prior art had to offer.

BROWN, ET AL., U.S. Pat. No. 4,300,429, teaches a cutter blade assembly which cuts french fry strips of varying cross-sectional area so as to compensate for the non-uniform solids content between the center of the potato and the peripheral areas so that the end product french fries will cook at a uniform rate. The cutter blade assembly as taught by BROWN provides an end product having a cross-sectional area which is smaller than that as taught by LAMB, but not as small as that necessary for shoestring potatoes or dehydrated food products.

In its preferred embodiment, the BROWN device has blade spacings which produce a plurality of french fries having cross-sectional areas of approximately 0.08 square inches. Small potato strings on the other hand, especially those suitable for dehydration, typically have cross-sectional areas of approximately 0.0062 square inches, corresponding to almost a 1300% reduction in cross-sectional area. Increasing the number of blades of BROWN, and therefore decreasing the spacing between blades so as to decrease the resulting cross-sectional area of the food segment, will result in clogging of the cutter blade assembly.

Additionally, the cutter assembly as taught by BROWN, produces a cut french fry which has feathered edges and substantial damage to the cells of the potato. This damage is a result of turbulent flow and the food segments being compressed within the individual passages created by the cutting blades.

As a general rule it can be said that adding more cutting blades to these devices in order to decrease the cross-sectional area of the segments of cut food product will result in frequent clogging of the cutter blade assembly and a substantial decrease in the quality of the final product resulting from feathered edges and broken segments caused by the multiple and repeated impingements of the cut food product against the various blades in the cutter assembly. It is not known how or what causes feathered cuts other than it is known that there is an extremely turbulent flow of carrier medium through the cutter blade assembly and that the cut food segments, either in the process of being sheared from the food product core, or at some later time impinge either upon a multiple number of blades, or the same blade in a repeated oscillating fashion.

Additionally, the typical cutter assembly has an array of blades which cut the four sides of each segment simultaneously, thus causing compressive forces in the cut food segments. This results in cell damage which degrades the quality of the product. Additional problems resulting from these compressive forces are increase turbulent flows and possible pressure differentials across the passageway which alters and degrades laminar flow of the product through the cutter blade assembly.

If a hydraulic cutter blade assembly such as that taught by the present invention were developed which is capable of producing high quality cut food segments having a cross-sectional area as small as 0.0062 square inches, then a vast number of food products could be produced with the use of a high capacity hydroknife cutting system as opposed to mechanical cutter blades. Some of these products, and perhaps the most important would be the ability to cut strings or shoestring segments of potato having a cross-sectional area of 0.0062 square inches which is particularly well suited to blanching and drying processes to produce a basic dehydrated potato food product which can be processed into a variety of different final products depending upon regional culinary tastes and preferences. Another benefit would be the ability to mass produce high quality shoestring or European style french fries.

What is needed is a hydraulic cutter blade assembly which is capable of producing potato string cuts when used in a typical hydraulic cutting apparatus, resulting in the production of potato strings that are the full length of the potato. And further, a hydraulic cutting blade assembly capable of producing potato strings at substantially larger production volumes than possible with present mechanical cutting apparatus. Also what is needed is a cutting blade assembly which reduces feather cuts and virtually eliminates cell damages caused by unnecessary compression of the cut food segments.

Accordingly, it is an object of this invention to provide a cutter blade assembly which can be utilized in a hydraulic food cutting apparatus to cut a food product into elongated segments, each having a substantially smaller cross-sectional area than was previously possible using hydraulic food cutters, and further capable of producing elongated string cuts of large, medium or small cross-sectional areas, which are free from feather cuts and cell compression damage.

DISCLOSURE OF INVENTION

These objects are achieved by use of a cutter blade assembly which can be configured in any number of different embodiments, all having one common feature which is that the assembly presents a sequential series of cutting knife arrays which are perpendicularly oriented one to the other so that food entering the cutter blade assembly sequentially engages each array of cutter blades as it passes through the cutter blade assembly.

In a first embodiment, a front inlet adapter plate having a conical converger accelerates uncut food product and carrier medium into a longitudinal passageway defined by two pairs of opposing pyramidal frame members. Attached to each pair of pyramidal frame members are a plurality of sequentially staggered arrays of strip knives. Each strip knife has a bevelled side and a flat side forming a cutting edge. The knives are attached to the frame members to present their flat side toward the centerline of the longitudinal passageway, so as to deflect sheared food product away from the longitudinal passage thus minimizing repeated impingements of the cut food product with either the same knife, or another, and the resulting feathered cuts.

Additionally, by sequentially arranging the arrays of strip knives, the food product being cut is not subjected to compressive forces which can cause cellular damage.

The final two cutting arrays at the end of the pyramidal arrangement consist of single strip knives, also referred to as quartering knives, each bisecting the remaining central segment of food product coincident to the centerline of the longitudinal passageway, again eliminating compressive forces on the food segments as they are being cut.

In a second embodiment, a planar stabilizing blade which runs substantially the entire length of the longitudinal passage is provided as a means for stabilizing and directing the core of the food product being cut through the longitudinal passageway. The planar stabilizing blade substitutes for one of the quartering knives found in the last array of the pyramidal assembly of the first embodiment and is anchored in place by means of engagement with interior grooves on one pair of opposing frame members.

In both embodiments, engagement slots are provided on the strip knives for one of the perpendicular orientations for engagement with the strip knives of the second perpendicular orientation to provide a means for interlocking the grid of strip knives to enhance structural rigidity of the strip knife array during use.

BEST MODE FOR CARRYING OUT INVENTION

Figure 1:
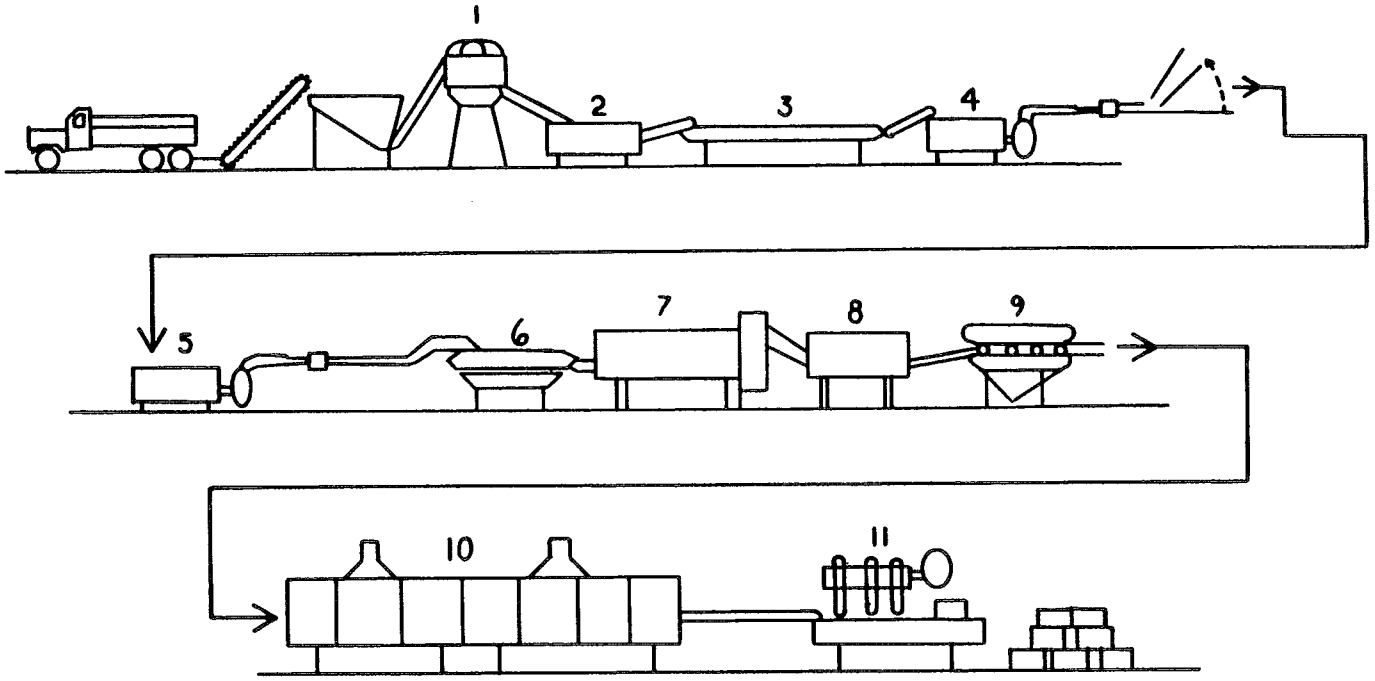
FIG. 1 is a schematical representation of a processing line for producing a dehydrated string potato product from raw potatoes.

The first embodiment of the present invention is a cutter blade assembly designed to produce string like potato segments having a cross-sectional area of approximately 0.0062 square inches which are suitable for dehydration. The equipment necessary to process raw potatoes into a dehydrated food product as contemplated by this invention is schematically represented in FIG. 1. Referring to FIG. 1, raw, whole potatoes are introduced into steam peeler 1 and then into skin remover 2. After the skin is removed they are manually inspected on inspection belt 3 and introduced into a first cutter 4. Because of the large number of cuts made in the new cutter, the pyramidal frame assembly necessary to cut a whole potato would be too long, and therefore not retrofittable into existing hydroknife machines. To reduce the number of cuts, and therefore the length of the cutter, the potatoes must first be precut so to reduce core sectional area to a more uniform and usable size. In practice it has been found that first cutting the whole potatoes into ¾ inch or smaller segments produces satisfactory results with my current design. After being cut by first cutter 4, the potatoes are then introduced into a second cutter 5 which contains my new cutter blade assembly which actually produces the string cuts. The string cuts are then removed from the carrier medium by dewatering shaker 6 and introduced into blancher 7. After blanching, the string cuts are then chilled in chiller 8. The next steps are to extract the water from the cut food product in water extractor 9 and then to dry it in a two stage belt drier, 10, before final packaging in packager 11.

Figure 2:
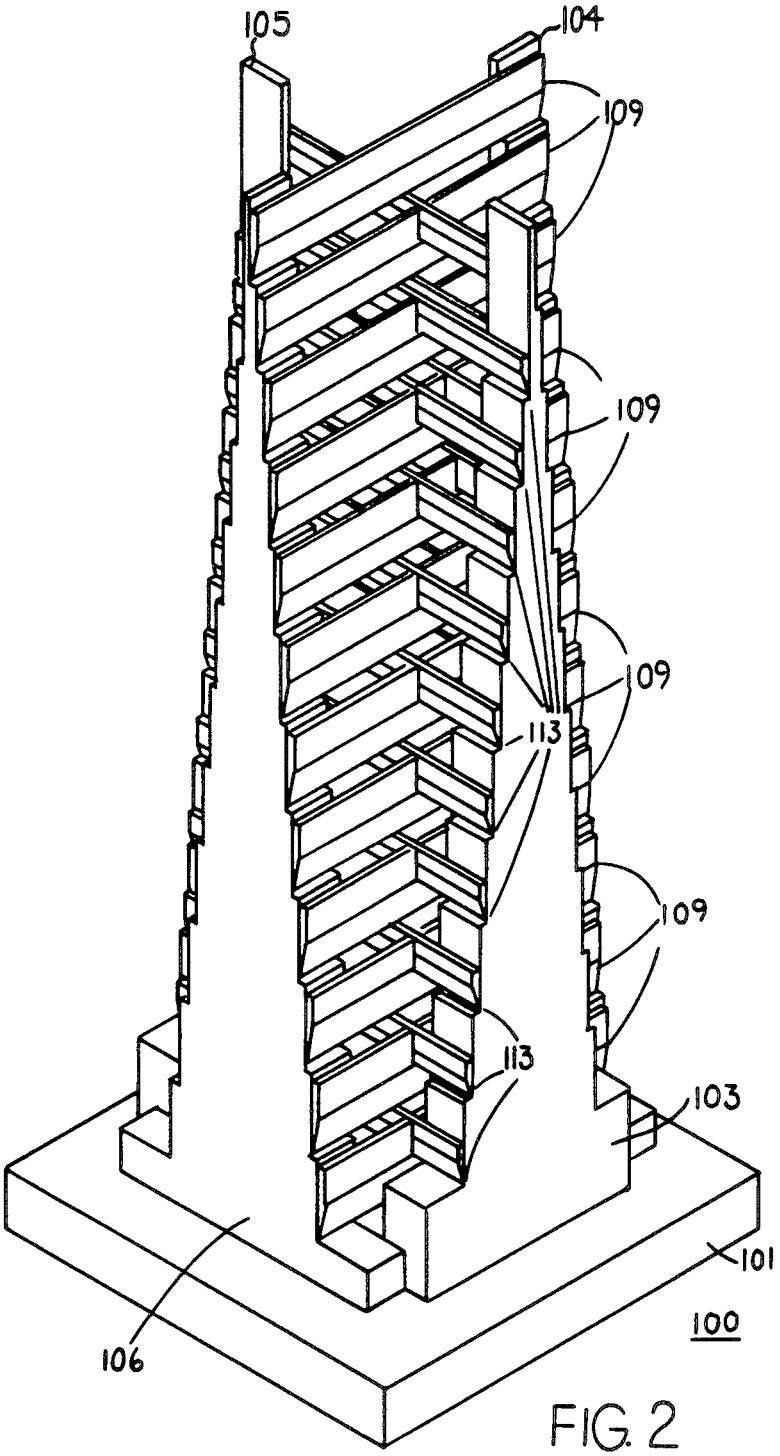
FIG. 2 is a representational perspective view of a first embodiment of my new cutter blade assembly.
Figure 3:
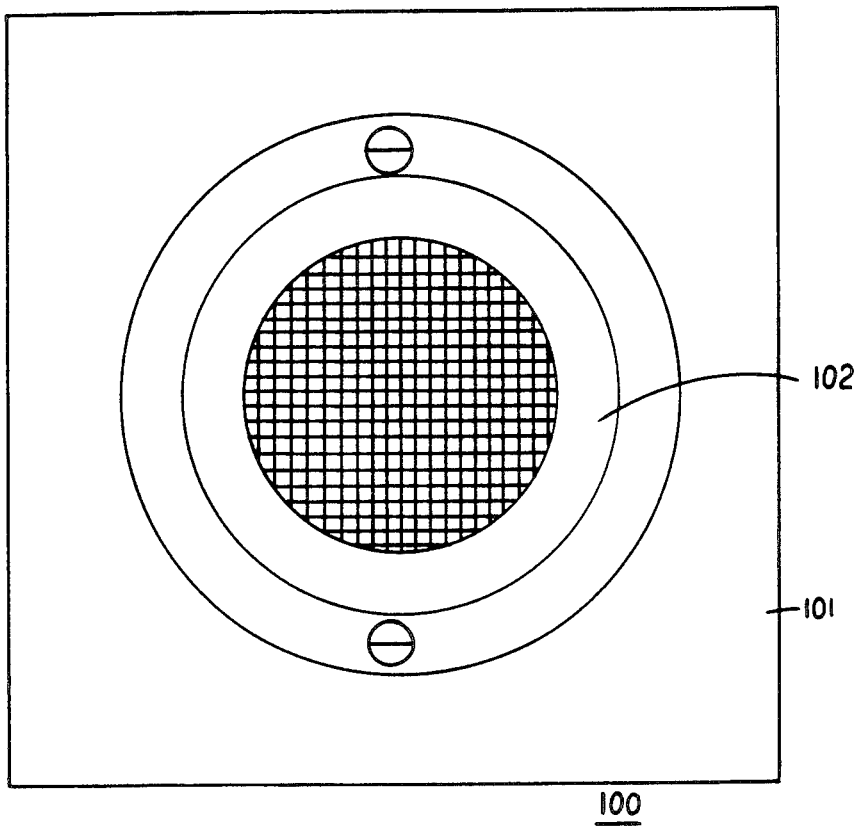
FIG. 3 is a front plan view of the first embodiment.
Figure 4:
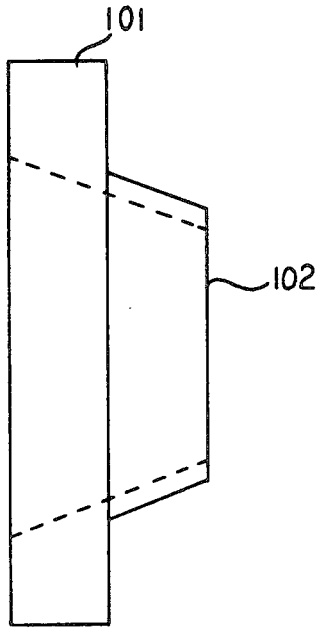
FIG. 4 is a sectional side view of the frontal inlet adapter plate and conical converger.

Referring now to FIGS. 2 through 9, a first embodiment for my cutter blade assembly, generally designated as 100, which is capable of producing small cross-sectional area string cuts, which are free from feather cuts and cell damage resulting from turbulent flow and compression, is shown. FIG. 2 shows cutter blade assembly 100 resting face down on front inlet adapter plate 101. In use, the cutter blade assembly would be oriented so as to receive food product and carrier medium through the hole in front inlet adapter plate 101, after which it travels generally along the longitudinal centerline of the cutter blade assembly through staggered arrays of cutter blades before exiting cutter blade assembly 100. Front inlet adapter plate 101 can be sized so it is retrofittable to a typical hydraulic food cutting apparatus. A longitudinal passageway is disposed within front inlet adapter plate 101, as shown in FIGS. 3 and 4. It is shaped to form conical converger 102. Conical converger 102 acts as an accelerating venturi for the vegetable product and carrier medium. Conical converger 102 generally has a decreasing cross-sectional area which converges toward and is centered about the longitudinal centerline axis of cutter blade assembly 100.

Pyramidal knife supports 103, 104, 105 and 106 are attached in opposing pairs to the back side of front inlet adapter plate 101 around the perimeter of conical converger 102 to form a pyramidal frame which defines a longitudinal passageway.

Figure 5:
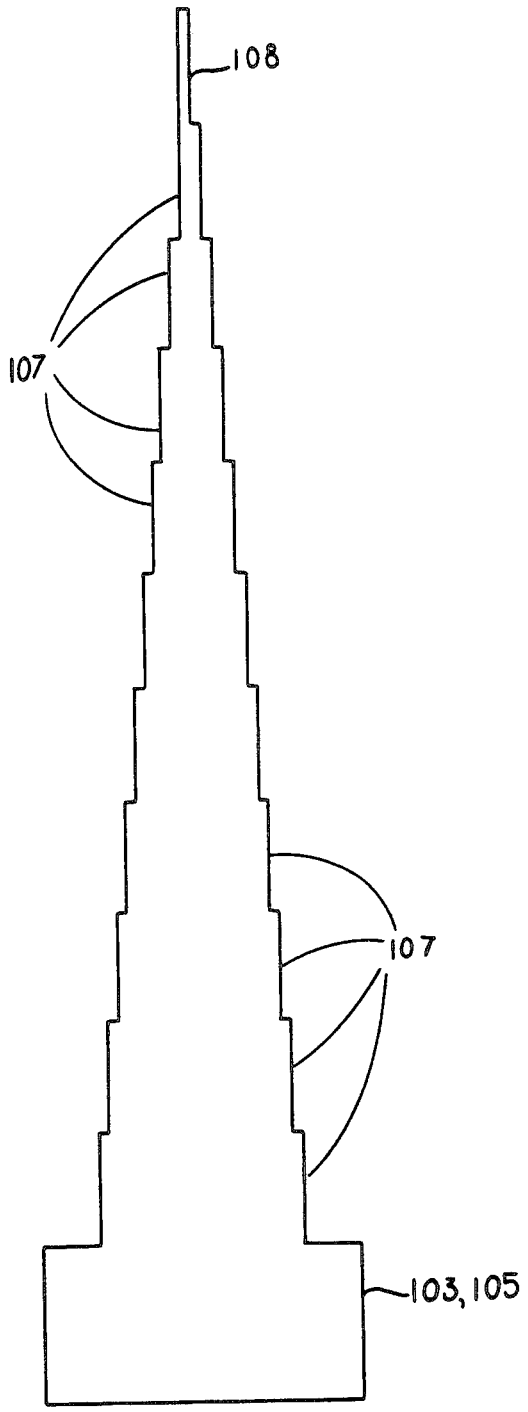
FIG. 5 is a first side view of the frame assembly of the first embodiment.
Figure 6:
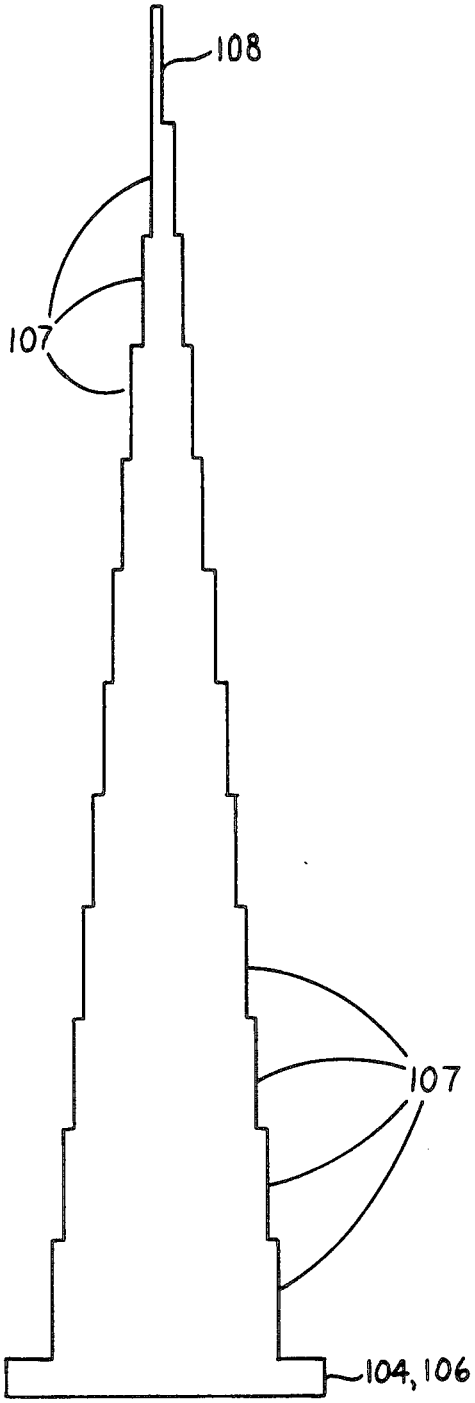
FIG. 6 is a second side view of the frame assembly of the first embodiment.

As shown in FIGS. 5 and 6, pyramidal knife supports 103, 104, 105 and 106 have a plurality of sequentially staggered attachment surfaces 107 disposed in a staggered manner up the pyramidal knife support sides. Each attachment surface 107 has an opposing attachment surface 107 located equidistant from and parallel to the centerline axis of longitudinal passageway of cutter blade assembly 100. The peak attachment surfaces 108 are disposed to intersect the centerline axis such that any blade connecting two opposing peak attachment surfaces 108 will exactly bisect the centerline axis which is the optimum food path.

Figure 7:
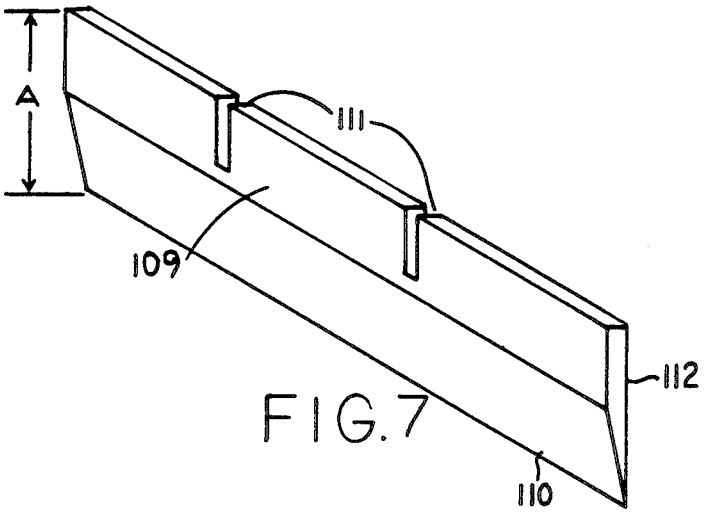
FIG. 7 is a perspective representational view of a slotted strip knife.
Figure 8:
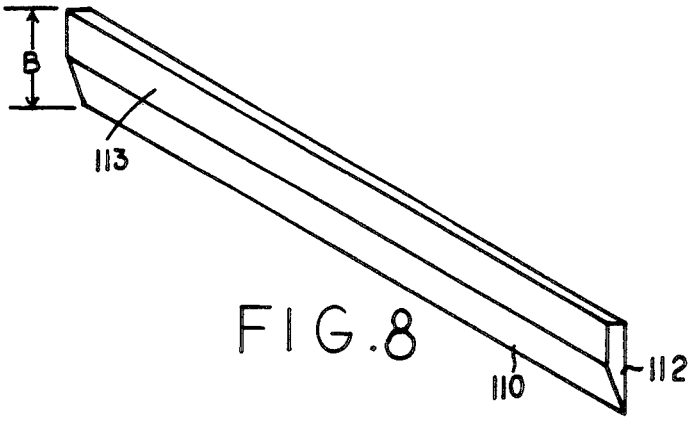
FIG. 8 is a perspective representational view of a cross strip knife.

Two types of knives are used in this first embodiment as shown in FIGS. 7 and 8. FIG. 7 shows a slotted stripe knife 109, FIG. 8 a standard cross strip knife 113. In other embodiments, thinner cross knives (not shown) can be used in the upper reaches of the pyramidal frame structure. Each of the knifes has certain common features which are important to the function of my new cutter blade assembly. In particular, each knife has a bevelled side 110 and a flat side 112 used to form the cutting edge of all the knives.

Referring now to FIG. 2, pairs of slotted strip knives 109 are attached, at the attachment surfaces 107 to pyramidal knife supports 104 and 106 to form a series of sequentially staggered, parallel cutting blade arrays. In a like manner, cross strip knives 113 are attached to pyramidal knife supports 103 and 105 to form a similar parallel, sequential, array of cutting blade knives. As can be seen in FIG. 2, cross strip knives 113 interlock in engagement slots 111 of slotted strip knives 109 to provide structural stability for cross strip knives 113 when in use.

Figure 9:
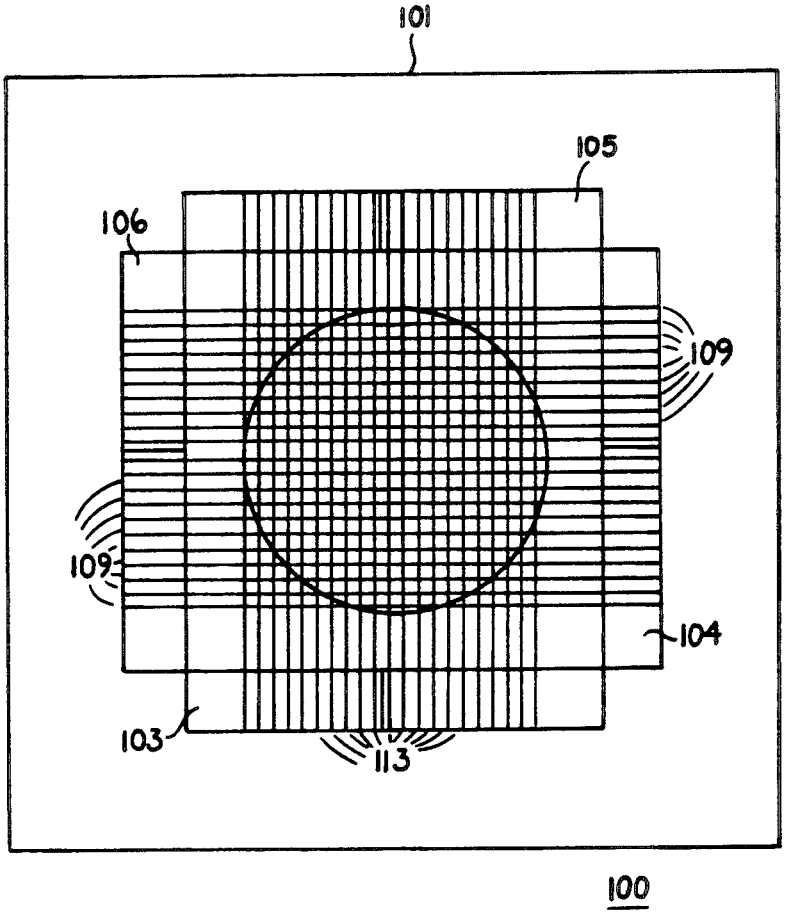
FIG. 9 is a plan view of the discharge end of the first embodiment of my cutter blade assembly.

When fully assembled, the sequential arrays of strip knives 109 and 113 together form a cutting grid, which, when viewed from the discharge end of the assembled apparatus as is shown if FIG. 9, provides for cutting a food product into segments having a uniform cross-sectional area of the particular desired size, which in this case is 0.0062 square inches.

In practice it has been found that it is necessary to pass the carrier medium and the food product to be cut through the assembled cutter blade assembly 100 at speeds substantially higher than that used in conventional hydraulic cutter blade apparatus. As a result it is necessary not only to accelerate the carrier medium of food product prior to entry into the cutter blade array, but also to provide for an increased laminar flow of carrier medium through the actual cutter blade array. This is accomplished by the use of the two different cutter knife blades, slotted strip knives 109 and cross strip knives 113. As can be seen in FIG. 2, 7 and 8, cross strip knives 113 have depth B, which is substantially shorter than depth A for slotted strip knives 109. This configuration provides for increased water passage between the sequential arrays of cutter blades and provides room for a more laminar flow or discharge of water and cut food product at the point where it is being cut.

In a standard design the cross-sectional area of the standard blade assembly is the effective cross-sectional area through which both the food product and the carrier medium must pass. In my new design, the effective cross-sectional area is substantially and effectively increased because not all of the carrier medium must pass through all of the cutter assembly, but rather can and does escape at each cutting array. In effect the area available for the carrier medium to pass through my new cutter assembly is increased by a factor of the length of the extended cutter blade assembly and the resulting blade spacing. This results in less turbulent, more laminar flow of carrier fluid and cut food product.

The sequential arrangement for blades, and their sequentially perpendicular orientation, as shown in FIG. 2 results in the whole food product impinging upon one cutting array at a time, in sequence, which minimizes the drag resulting from shearing and frictional forces during the cutting process. Also, the staggered sequential array of cutting knives eliminates compressive forces on cut food segments resulting from compression in a passageway defined by more than two cutting blades in an array of the typical prior art cutting apparatus.

Again referring to FIGS. 2, 7 and 8, it can be seen that all of the strip knives 109 and 113 are attached to their respective pyramidal frame members in an orientation wherein bevelled side 110 faces out from the longitudinal centerline of the cutter blade assembly. In this manner, finished cut food product is directed out and away from the core area. This, in conjunction with the increased discharge of carrier medium between the sequential arrays of blades, results in a flow of carrier medium and cut food product out and away from the centerline of the cutter blade assembly. Thus eliminating feathered cuts and broken segments in the peripheral area of the food product. Further, this arrangement insures that the food product is not compressed between the bevelled side and any other flat surface thereby substantially reducing damage resulting from cell compression.

The last two knives in the pyramidal array attached to peak attachment surfaces 108 of each pyramidal frame member, as shown in FIGS. 2, 5 and 6, function as quartering knives which divide the cross-sectional area of the remaining central core of the food product into four equal sections without imposing any compressive forces on these remaining central segments of the cut food product. This is an important feature since a major percentage of cell compression damage and feathered cuts are found on food segments cut from the central core of the food product.

The design of pyramidal knife supports 103, 104, 105 and 106, in conjunction with the engagement slots 111 of slotted strip knives 109, provide for a staggered perpendicular interlocking arrangement of strip knives as specifically shown in FIGS. 2 and 9. The removable attachment of all said planar strip knives is here accomplished by the use of allen head bolts and hex nuts (not shown). It is necessary to provide for removable attachment so that the strip knives may be sharpened and replaced as necessary.

Figure 10:
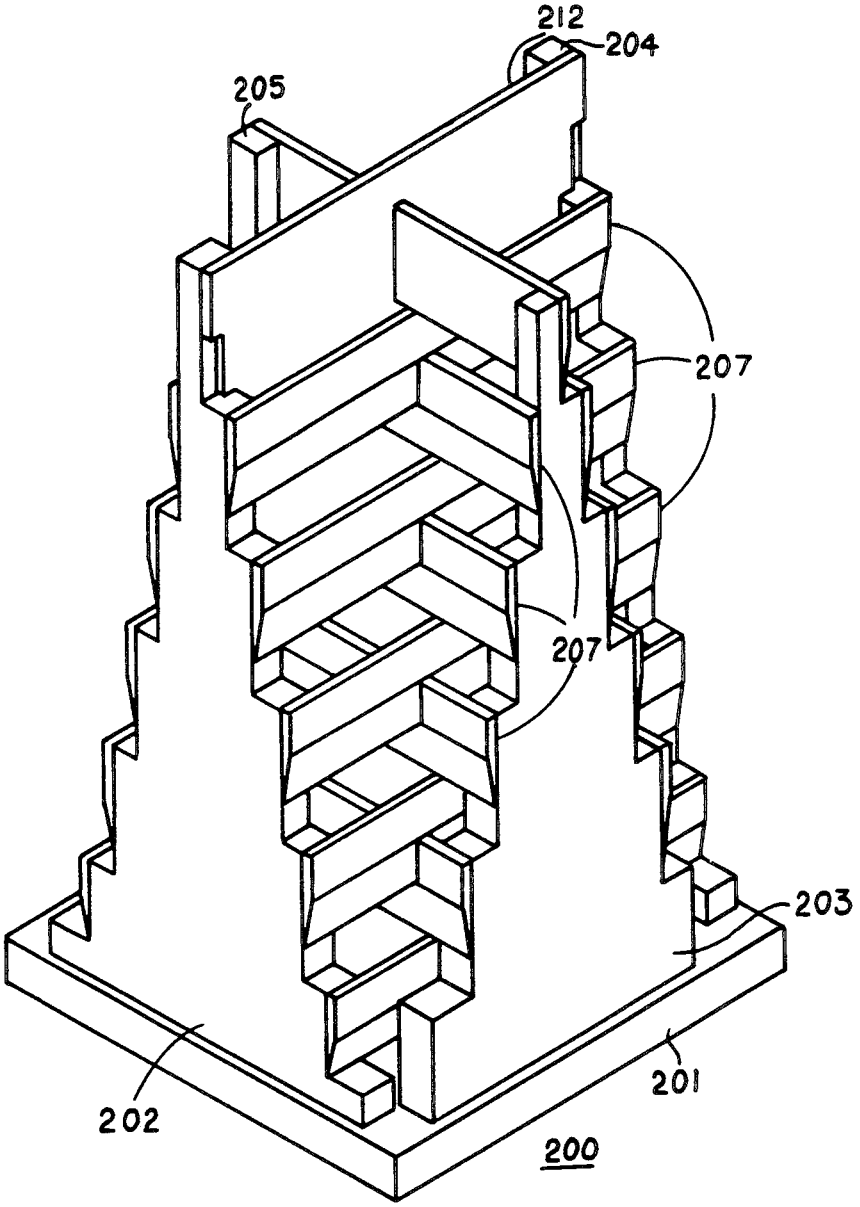
FIG. 10 is a perspective representational view of the second embodiment of my cutter blade assembly.
Figure 11:
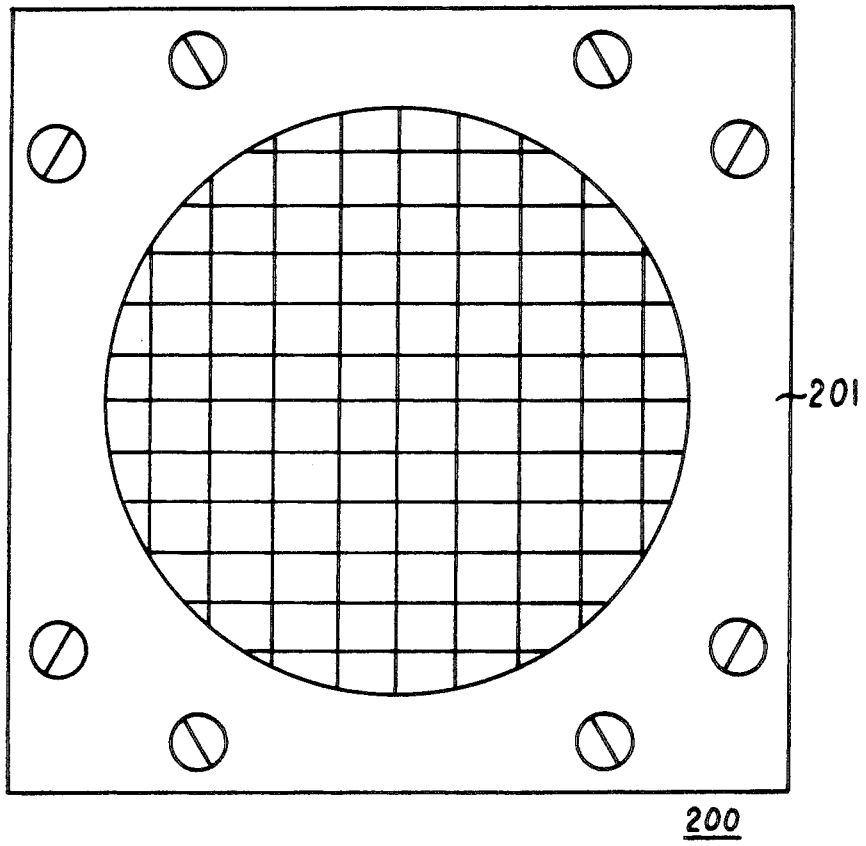
FIG. 11 is a plan view of the inlet of the second embodiment.

Referring now to FIGS. 10 through 15, a second embodiment of the cutter blade assembly, which is generally designated as 200, is shown which is capable of producing larger cross-sectional area potato segments which are free from feather cuts and compression damage. Cutter blade assembly 200 is shown in FIG. 10 resting on the front face of front inlet adapter plate 201. Front inlet adapter plate 201 is sized to be retrofittable to a typical hydraulic cutting apparatus and further has a longitudinal passageway there through as shown in FIG. 11. Pyramidal knife supports 202, 203, 204 and 205 are attached around the perimeter of the longitudinal passageway. A first pair of opposing pyramidal knife supports 202 and 204 are attached in parallel spaced relation at opposing sides of the longitudinal passageway. A second pair of opposing pyramidal knife supports 203 and 205 are again attached in a parallel spaced relation at opposing points around the perimeter of the inner longitudinal passageway and further disposed perpendicular to the first pair of pyramidal knife supports 202 and 204 to form a pyramidal frame assembly.

Figure 12:
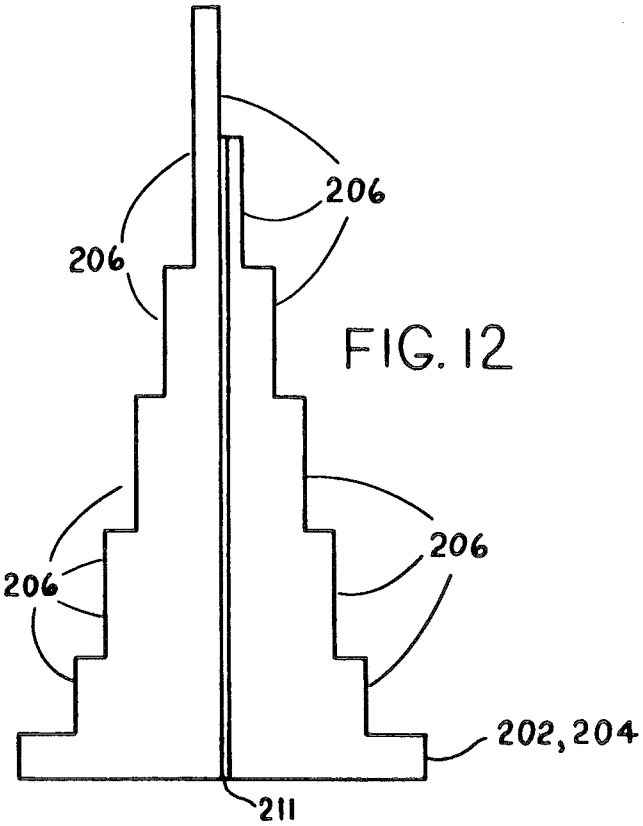
FIG. 12 is a first side plan view of the frame of my second embodiment.
Figure 13:
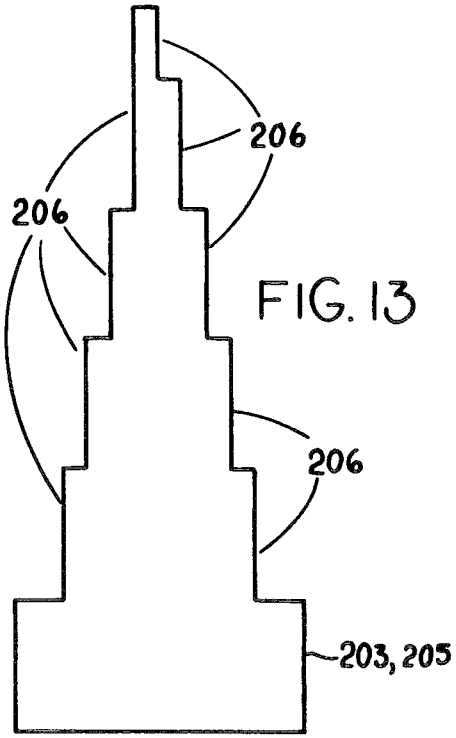
FIG. 13 is a plan view of a second side of the frame of the second embodiment.
Figure 14:
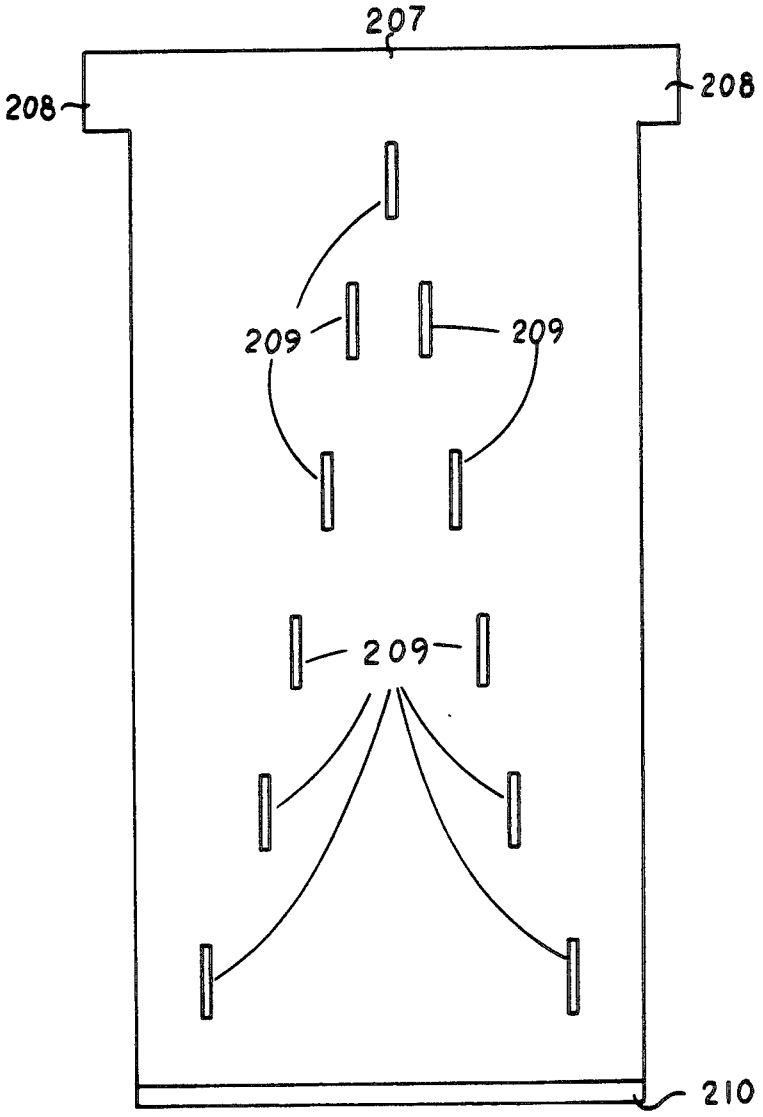
FIG. 14 is a side plan view of the planar stabilizer blade for the second embodiment.

Referring to FIGS. 12 and 13, each of the pyramidal knife supports 202, 203, 204 and 205, have attachment surfaces 206 disposed parallel to the longitudinal centerline axis of cutter blade assembly 200 in a manner identical to that of pyramidal knife supports 103 through 106 of the first embodiment.

Slotted strip knives 109, as shown in FIG. 7, are attached to pyramidal knife supports 202, 203, 204 and 205 in the same fashion as disclosed for the first embodiment.

Planar stabilizer blade 207, as shown in FIG. 16, is provided in this second cutter blade assembly embodiment 200 to provide a stabilizing means for directing and keeping the core of the food product being cut parallel to the longitudinal centerline axis of cutter blade assembly 200 to reduce feather cuts. It has a double sided bevelled cutting edge 210, cross strip knife engagement slots 209 through which the array of cross strip knives are inserted and anchor tabs 208. Planar stabilizer blade 207 substitutes for the last quartering knife 109 as shown in the first embodiment and is anchored in place by means of engagement with interior groves 211 on pyramidal knife supports 202 and 204 and anchor tabs 208 which are sized for engagement with the standard hex nut and bolt arrangement of the pyramidal frame members as in the same manner and fashion as with the remaining slotted strip knives 109. A second quartering knife is also provided as in the first embodiment.

As in the first preferred embodiment the arrays of cutting knives are sequential, and arranged in perpendicular sequential orientation with slotted strip knives 109 attached to pyramidal knife supports 203 and 205 to present a sequential series of cutting blade arrays. Cross strip knives 113, as shown in FIG. 8, are attached to the opposing pyramidal knife supports 202 and 204. Slotted strip knives 109 are further held in place by insertion through cross strip knife engagement slots 209 of planar stabilizer blade 207.

Figure 15:
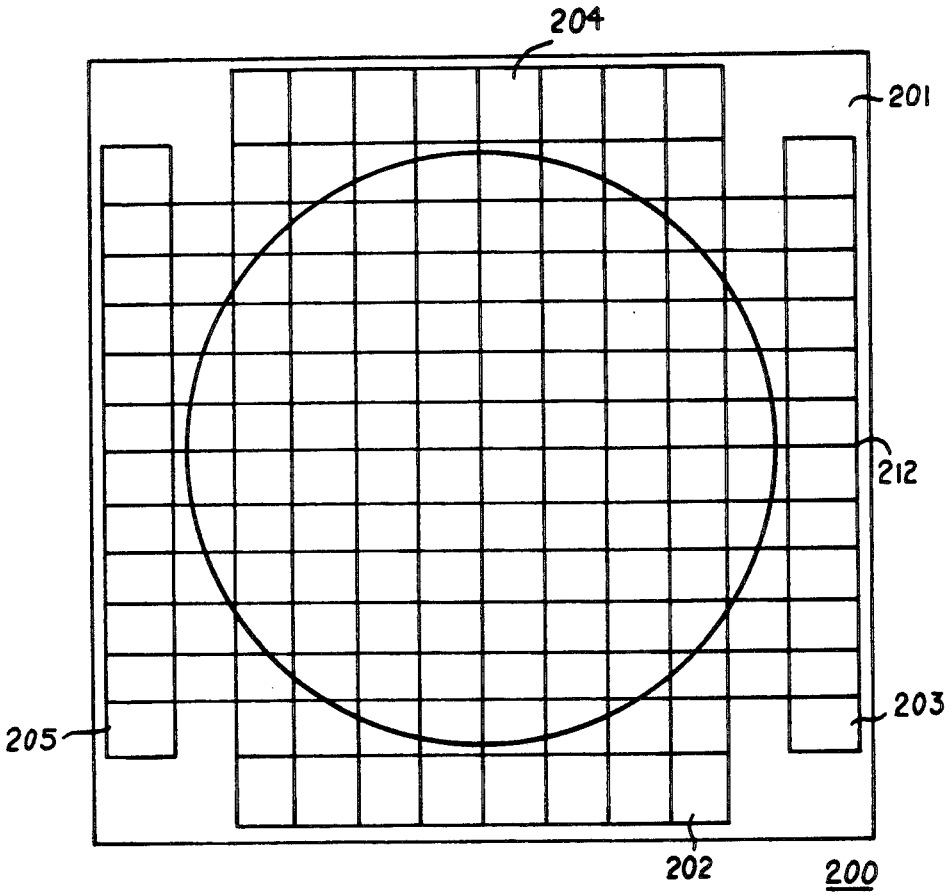
FIG. 15 is a plan view of the discharge end of the second embodiment of my cutter blade assembly.

As in the first embodiment, the slotted strip knives 109 and cross strip knives 113 have a flat side 112 and bevelled side 110 which form the cutting edge for the blade. Also, each slotted strip knife 109 has engagement slots 111 for purposes of interlocking the perpendicularly oriented and sequential arrays of cross strip knives 113. When assembled the opposing arrays present a grid of cutting edges as shown in FIGS. 11 and 15.

In addition to serving as a guide for the food product as it travels through the cutter blade assembly 200, planar stabilizer blade 207 provides structural support for the array of slotted strip knives 109. This, in combination with the interlocking feature provided by engagement slots 111 of slotted strip knives 109, enhances structural rigidity of the entire cutter blade array and minimizes bowing and breakage of slotted strip knives 109 and cross strip knives 113 when in use. In practice this has been found to be a significant feature since one of the major problems with hydraulic cutting devices currently in use is that the blade arrays, particularly the ones first engaged by the food product at the beginning of the cutting process, will bow when impacted by a food core of substantially the same width as the first set of blades.

Again, the removable attachment of all said strip knives is accomplished by the use of allen head bolts and hex nuts (not shown). It is necessary to provide for removable attachment so that the strip knives may be removed for sharpening or replacement as necessary.

While there is shown and described the present preferred embodiment of the invention, it is to be distinctly understood that this invention is not limited thereto but may be variously embodied to practice within the scope of the following claims.

I claim:

1. A cutter blade assembly for use in a hydraulic food cutting apparatus which comprises:

a frame defining a longitudinal passageway having upstream and downstream ends for passage of food product and carrier medium therethrough;

a first plurality of strip knives being removably attached to said frame in pairs, in parallel spaced relation, along the longitudinal passageway;

a second plurality of strip knives each having engagement slots therein for perpendicularly engaging the strip knives of said first plurality of strip knives, said second plurality of strip knives being attached to said frame in pairs alternately interspaced between the pairs of said first plurality of strip knives and having their engagement slots in engagement with the next downstream pair of the first plurality of strip knives, and in perpendicular spaced relationship with the adjacent upstream pair of the first plurality of strip knives;

said first and second pluralities of strip knives being attached to said frame to define a pyramidal array having a converging point at the downstream end of said frame; and a pair of quartering knives disposed perpendicularly one to the other and removably attached to said frame at the converging point of said pyramidal array and being further disposed to engage and quarter each of the food products passed therethrough.

2. The cutter blade assembly of claim 1 further comprising a front inlet adapter plate having an inner longitudinal passageway shaped to form a conical converger for the acceleration of food product therethrough being attached to the inlet of the frame.

3. The cutter blade assembly of claim 2 wherein the strip knives have a flat side and a beveled side which form a cutting edge, disposed within said passageway and oriented so said flat sides face the longitudinal passageway centerline.

* * * * *